United States Patent [19]

Marulic

[11] 4,279,203

[45] Jul. 21, 1981

[54] PASSENGER CAR COMPARTMENT UPPER SLEEPING BERTH SUPPORT ASSEMBLY

[75] Inventor: Walter J. Marulic, Gary, Ind.

[73] Assignee: Pullman Incorporated, Chicago, Ill.

[21] Appl. No.: 84,488

[22] Filed: Oct. 15, 1979

[51] Int. Cl.[3] ..... A17C 17/38; B61D 1/02; B61D 31/00

[52] U.S. Cl. ..... 105/321; 5/9 R; 105/322

[58] Field of Search ..... 105/321, 322, 314, 315, 105/316; 5/9 R

[56] References Cited

U.S. PATENT DOCUMENTS

| | | | |
|---|---|---|---|
| Re. 3,419 | 5/1869 | Creighton | 105/321 |
| 1,846,824 | 2/1932 | White | 105/321 |
| 2,004,898 | 6/1935 | Marchant | 105/321 |
| 2,541,156 | 2/1951 | Fike | 105/321 |
| 2,550,599 | 4/1951 | Reed | 105/321 X |
| 2,676,333 | 4/1954 | Patton et al. | 105/321 X |
| 4,138,949 | 2/1979 | Gutridge et al. | 105/321 X |
| 4,227,465 | 10/1980 | Gutridge et al. | 105/321 |

FOREIGN PATENT DOCUMENTS

| | | | |
|---|---|---|---|
| 940827 | 6/1948 | France | 105/322 |

*Primary Examiner*—Joseph F. Peters, Jr.
*Assistant Examiner*—Howard Beltran
*Attorney, Agent, or Firm*—Richard J. Myers

[57] ABSTRACT

A sleeping berth movable between storage and sleep positions and having hinge means connecting the berth to a compartment wall, releasable latch means including latch levers for engaging within latch keepers, guide means for guiding the berth during movement between positions and means for locking the berth in the sleep position. The guide means comprise a horizontal guide track having closed ends, a guide roller supported for movement within the guide track and a berth support link, the support link having one end portion pinned to the berth and the other end portion connected to the guide roller. One end of the support link engages a latch lever and locks the berth while disposed in the sleep position.

14 Claims, 8 Drawing Figures

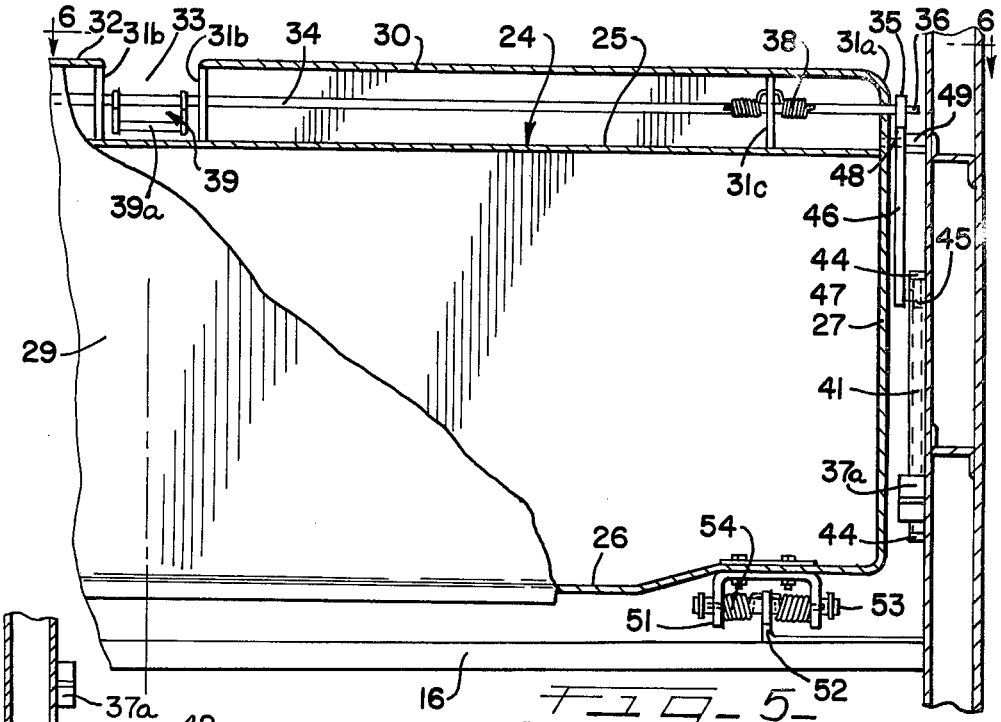
FIG. 5
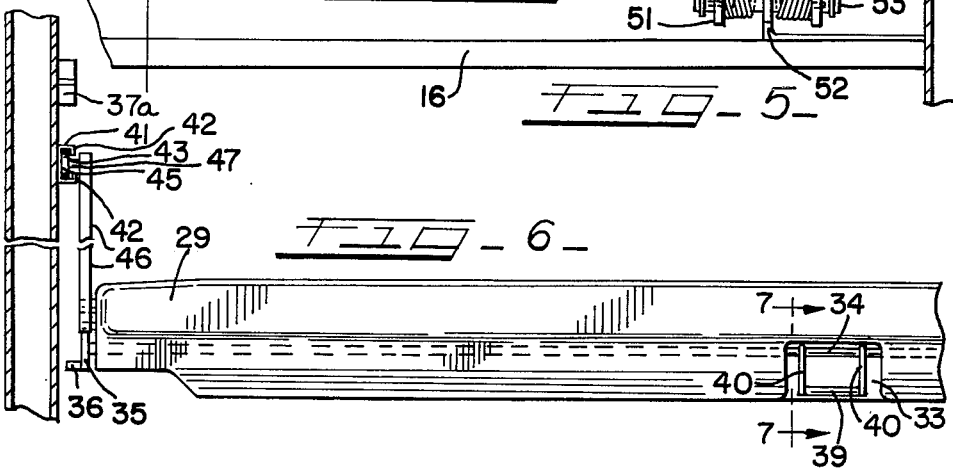
FIG. 6
FIG. 7
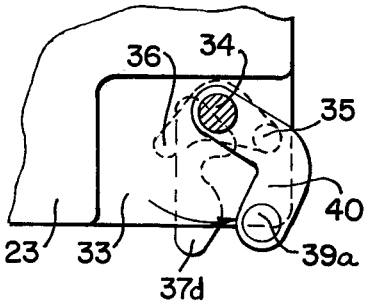
FIG. 8
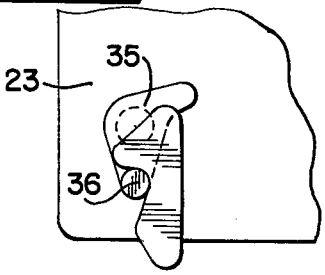

PASSENGER CAR COMPARTMENT UPPER SLEEPING BERTH SUPPORT ASSEMBLY

BACKGROUND OF THE INVENTION

1. Field of the Invention

The present invention broadly relates to railway car passenger compartments and more particularly to a compartment upper sleeping berth having a construction adapted to facilitate movement of the sleeping berth between storage and use positions.

2. Description of the Prior Art

The prior art includes a great number of patents pertaining to upper sleeping berths and disclosing various devices for locking and unlocking the berths and for guiding the berth between storage and use positions. Illustrative of prior berth constructions and mechanisms are the U.S. Pat. Nos. 1,846,824 to White, 2,004,898 to Marchant, 2,541,156 to Fike, 2,550,599 to Reed and 2,676,333 to Patten. While suitable for the purposes intended, the berths typified by the noted prior art are complex. The present invention provides an improved and simplified construction.

SUMMARY OF THE INVENTION

In the present construction, a railway car includes a passenger compartment having a longitudinally extending outer car side wall, a longitudinally extending divider wall spaced from the outer car side wall, a partition wall extending laterally between the side wall and the divider wall, passenger seats adjacent to the partition wall, a storage closet having a support ledge extending above the seats and a sleeping berth rotatably hinged to the partition wall, the sleeping berth being movable between a relatively vertical position adjacent to the partition wall and a relatively horizontal sleeping or in-use position extending outwardly from the partition wall. A horizontally extending guide track having closed ends or having a stop member secured against the ends is carried on the outer car side wall. A guide roller is disposed in the guide track and supported for movement therein between the ends of the guide track. A support link is provided for slidingly supporting one end of the berth during movement between the horizontal and vertical positions, one end portion of the support link being connected to the guide roller and the other end portion being pivotally connected to the berth. An abutment block carried on the outer car side wall positions and supports a portion of the support link when the berth is in the sleeping position. An elongation rod, rotatably carried by a plurality of webs extending from a front side of the berth, includes a latch lever connected at each end, each latch lever having a latch pin secured thereto. A plurality of latch keepers are disposed on the outer car side wall and divider wall, the latch keepers being adapted to be releasably engaged by a latch pin. One end of the support link has a cam-like end adapted to engage a latch lever and lock the berth in the sleeping position.

BRIEF DESCRIPTION OF THE DRAWINGS

FIG. 5 is an enlarged half-plan view of FIG. 1 with portions of the upper berth broken away to show interior construction of a berth frame;

FIG. 6 is a front elevational view of the berth taken along line 6—6 of FIG. 5;

FIG. 7 is a side view of the berth showing the berth handle taken along line 7—7 of FIG. 6; and FIG. 8 is an enlarged side view of FIG. 2 showing a latch lever latch pin engaged in a latch keeper.

DESCRIPTION OF A PREFERRED EMBODIMENT

Figure 1:
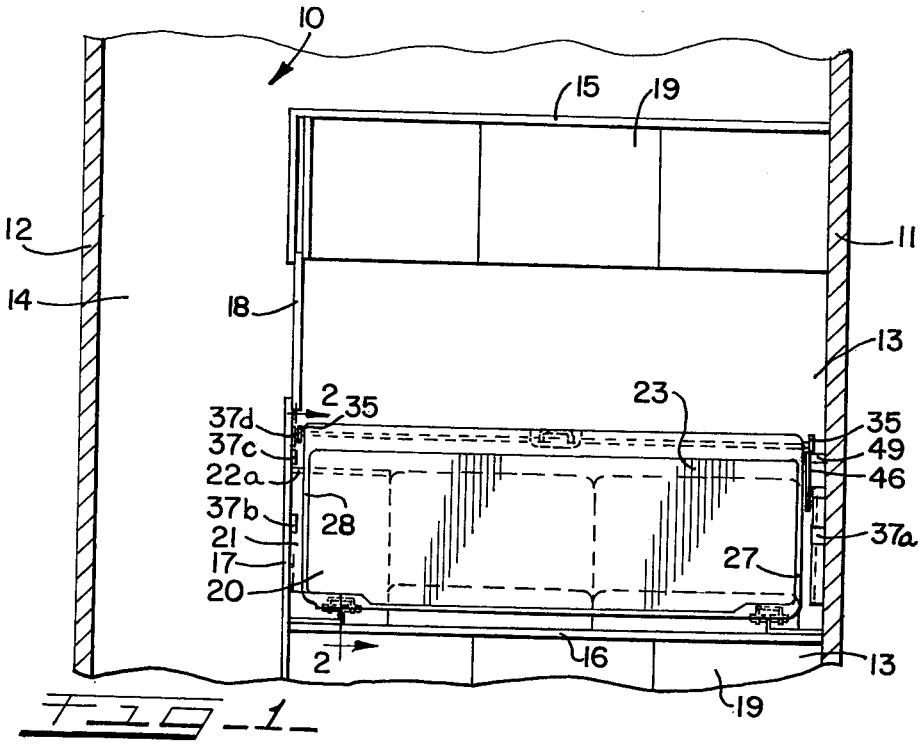
FIG. 1 is a top plan view of a railway car passenger compartment showing a seating and upper sleeping berth arrangement with the berth extended into a horizontal in-use position.

Referring now to the drawings wherein reference characters designate identical or corresponding parts throughout the several views and more particularly to FIG. 1 there is shown a plan view of a railway car 10 having a pair of longitudinally extending outer car side walls 11, 12 and including a plurality of longitudinally spaced passenger compartments 13 laterally extending from the outer car side wall 11 and spaced from the other outer car side wall 12 by a longitudinally extending aisle 14. Each compartment 13 is generally defined by a pair of longitudinally spaced partition walls 15, 16 extending laterally from outer car side wall 11 and a longitudinally extending divider wall 17 laterally spaced from the outer car side wall 11, the divider wall 17 including a sliding door 18 permitting access to the compartment 13. Firt and second spaced seats 19, 20 extend laterally in spaced relation between the divider wall 17 and the outer car side wall 11. A storage closet 21 having a support roof 22 and a support ledge **22*a* is provided between the end of seats 20 and the divider wall 17. Each compartment 13 also includes an upper sleeping berth 23 carried by the partition wall 16 above the seats 20 and adapted to be placed in a relatively vertical and storage position adjacent to the partition wall 16 and in a relatively horizontal in-use sleeping position extending outwardly from the partition wall 16, as shown in FIG. 1**.

Upper berth 23, shown best in FIGS. 1 and 5, generally comprises a berth frame 24 having front and rear side frame members 25, 26, a pair of end frame members 27, 28 connected to the front and rear side frame members, end frame members 27, 28 being adjacent the outer car side wall 11 and divider wall 17 respectively and a sleeping mattress or cushion 29 disposed in the berth frame 24. A plurality of webs 31 are secured to and extend outwardly from the front side frame member 25, a pair of outer webs **31*a* being disposed adjacent end frame members 27, 28, a pair of inner webs 31*b* being disposed centrally of the front side frame member and a web 31*c* disposed between the inner and outer webs 31*a*, 31*b* respectively. A pair of beams 30, 32 are secured to the ends of respective sets of inner, center and outer webs 31*b*, 31*c*, 31*a*. Inner webs 31*b* are spaced to form a recess 33. An elongated rod 34** extends through and is rotatably supported in the webs.

A manually operable and releasable latch mechanism comprises a latch lever 35 secured to the ends of the elongated rod 34, a latch pin 36 extending perpendicularly from each latch lever in the direction of the outer car side wall and divider wall respectively and a plurality of latch keepers 37, one latch keeper 37*a* being carried on the outer car side wall and, in the embodiment shown, three latch keepers 37*b*, 37*c* and 37*d* being carried on the divider wall. In accord with the present invention, latch keepers 37*a*, 37*b* are aligned and adapted to secure the berth in the storage position. Latch keeper 37*c* serves as a safety feature to catch the berth and prevent inadvertent lowering of the berth onto a passenger in the event the beth should be released from the storage position. Latch keeper 37*d* serves to secure the berth in the horizontal sleeping position. Preferably and in accord with the present invention, a torsion spring 38 is secured to each web 31*c* and positioned in circumposing relation about rod 34, end portions of the torsion spring abutting the rod and biasing the latch levers into a latch keeper engaging position. A handle 39 is disposed within recess 33, the handle comprising a pair of bell crank levers 40 secured at one end to rod 34 and a handle bar 35 connected to the other ends of the bell crank levers.

Figure 2:
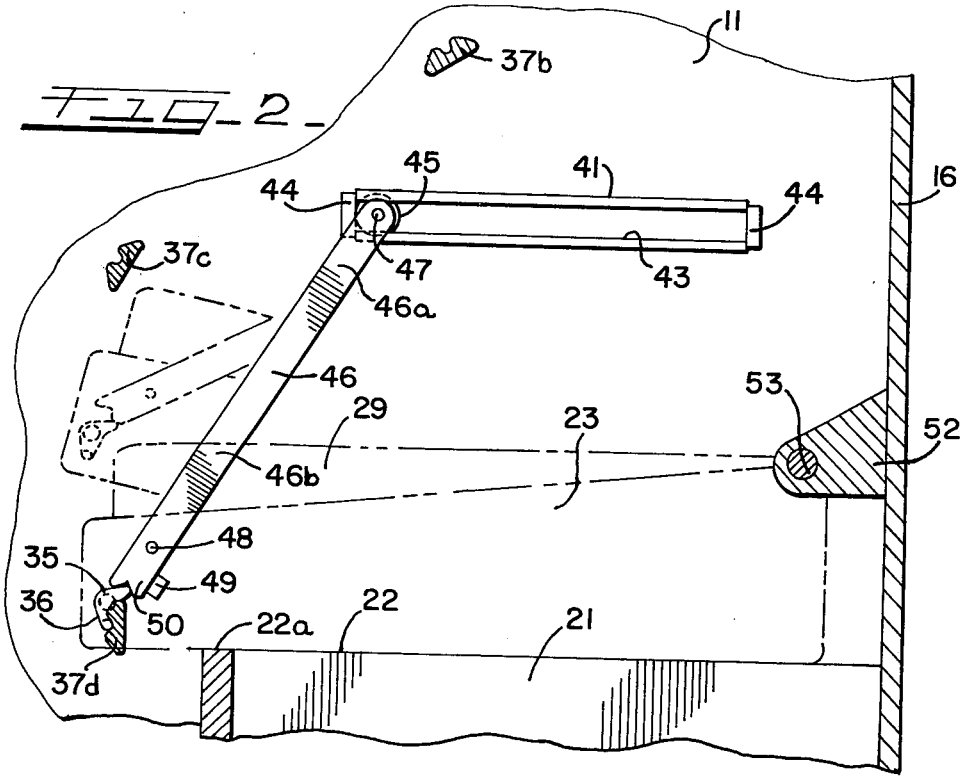
FIG. 2 is a partial side elevational view of the compartment showing detail of the upper berth arrangement taken along lines 2—2 of FIG. 1 through latch keepers carried on a divider wall with portions of the berth being in phantom to show a guide track carried on an outer car side wall and a support link locking the berth in the in-use position.

As shown best in FIG. 2, the berth arrangement includes an elongated, horizontally extending guide track 41 carried on the outer car side wall. The guide track includes inwardly extending flanges 42 defining an elongated slot 43 and is either closed at its ends or has a stop member 44 provided at each end. A guide roller 45 is retained by the guide track and supported for movement therein between the opposite ends. A support link 46 disposed between the outer car side wall and end frame 27 has an upper end portion 46*a* connected to the guide roller 45 by a pin 47 and has a lower end portion 46*b* connected to the berth by a pin 48, the support link slidably connecting the berth to the side wall and guiding one end of the berth from the storage and sleeping positions. An abutment block 49 carried by the outer car side wall extends outwardly therefrom and serves to support a portion of the support link when the berth is extended in the sleeping position. A cam-like end 50 on the lower end of the support link engages an end of the latch lever adjacent the outer car side wall and locks the berth into the sleeping position.

Figure 3:
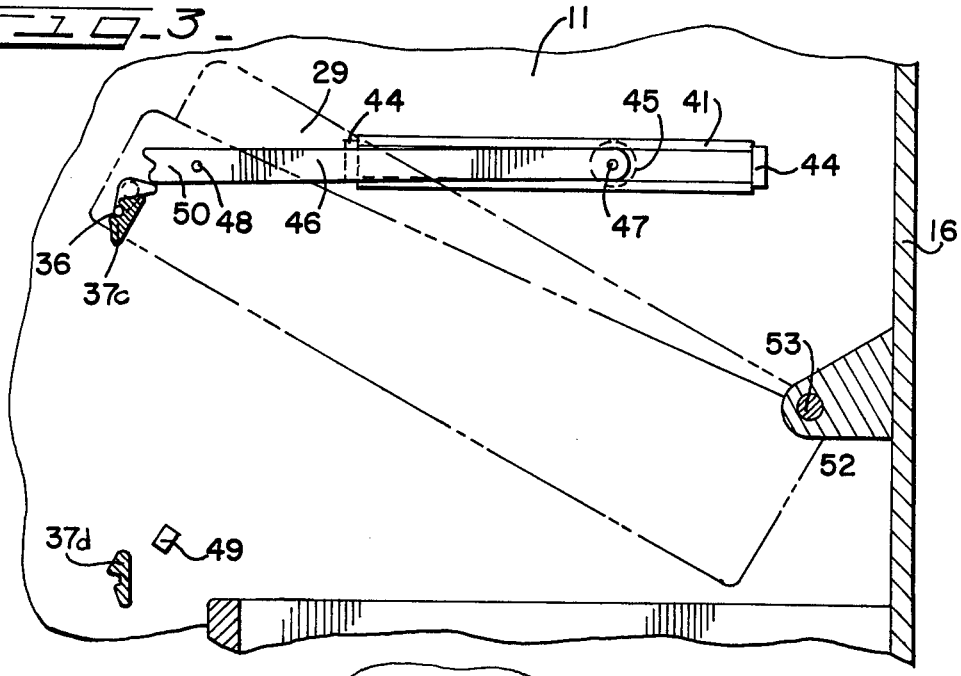
FIG. 3 is a side elevational view similar to FIG. 2 showing the berth secured in an intermediate safety position.
Figure 4:
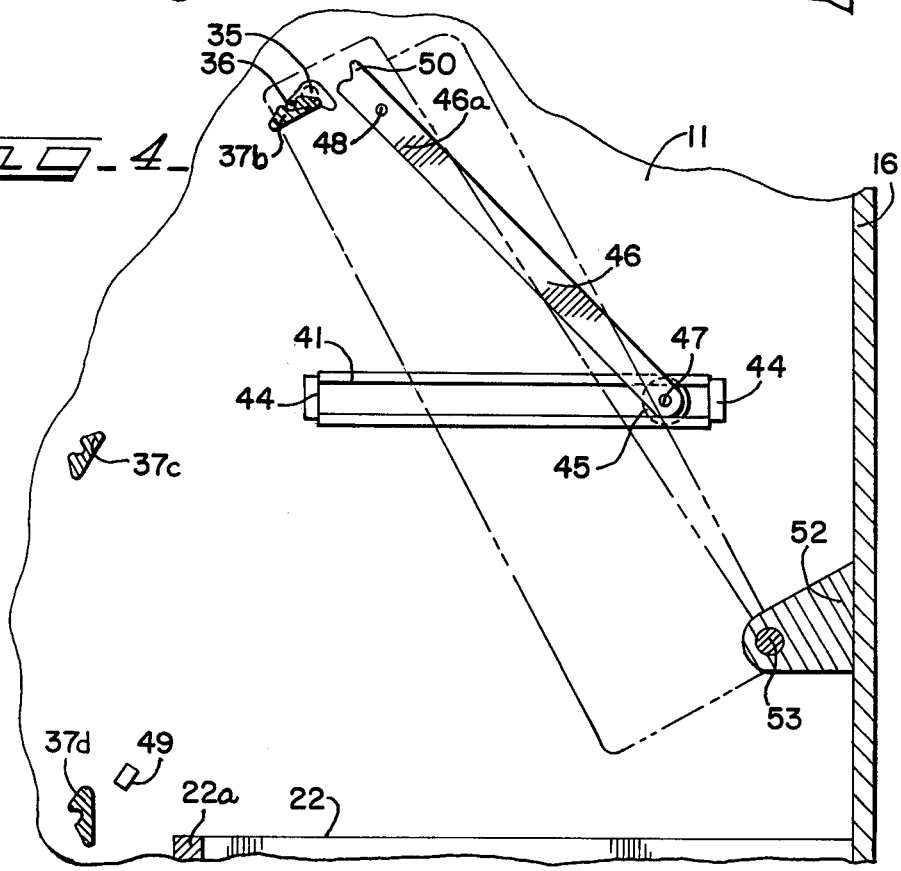
FIG. 4 is a side elevational view similar to FIG. 2 showing the berth being secured in the vertical or storage position.

Hinge means connect the rear side frame member 26 and the partition wall 16 and permit the berth 23 to pivotally swing from the relatively horizontal position wherein the berth extends horizontally outwardly of the wall, shown best in FIGS. 2 and 6, to the intermediate safety position, shown best in FIG. 3 and to the relatively vertical storage position wherein the front side frame member 25 is adjacent to the partition wall, shown best in FIG. 4. Preferably and in accord with the present invention hinge brackets 51, 52 are connected to the rear frame member and the partition wall 16 respectively by a hinge pin 53 extending through the brackets. A torsion spring 54 having end portions abutting the bracket 52 and circumposing the pin 53 is suitably anchored on bracket 51 so that the torsion spring will balance the berth during movement between each of the positions.

In the horizontal in-use position, the support ledge 22*a* supports one end portion of the berth, the other end portion being supported by the support link and abutment block 49.

OPERATION

FIGS. 1 and 2 show the passenger compartment in condition where the berth is horizontally extended into the sleeping position, the upper berth 23 being lowered onto the support ledge 22*a* of the storage closet 21, the support link 46 and 50 interlocked with a latch lever 35 and a latch pin 36 interlocked within the latch keeper 37*d*. In order to place the berth into the vertical position, shown in FIGS. 3 and 4, the operator merely grasps the handle 39 and pulls the handle bar 39*a* outwardly from the front side of the berth frame, whereupon the latch levers 35 are rotated, the latch pin 36 interengaged with latch keeper 37*d* caused to move out of engagement with the latch keeper and the cam-like end 50 disengaged from a locking relation with the latch lever 37*d*. The berth may now be raised to the safety, see FIG. 4, or to the storage position. In the safety position, latch lever 35 adjacent to the divider wall has the latch pin engage latch keeper 37*c*. In the storage position, the latch pin engages both the latch keeper 37*c* carried on the outer car side wall as well as the latch keeper 37*d* carried on the divider wall. The counterbalance hinge means using a torsional spring permits the user to easily move the berth upwardly until it is locked in the storage position. To return the berth to the horizontal in-use position, the above operation is merely reversed. Interlocking of one latch lever with the end of the support link is independent of the interengagement of the other latch lever with a latch keeper. The support link slides in the guide track at one end and holds the berth frame in the horizontal in-use position at the other end.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed is:

1. In a railway passenger car compartment having a outer car side wall, a longitudinally extending divide wall spaced from the side wall, a partition wall extending laterally between the side wall and the divider wa and laterally extending seats positioned adjacent th partition wall, the improvement comprising an upp sleeping berth arrangement having a berth frame defining the sleeping berth, the bert frame having front and rear side frame membe and end frame members connected to the sic frame members, hinge means connecting the rear side frame memb to the partition wall and for swinging the bert frame between a relatively vertical storage positic adjacent to the partition wall and a relatively hor zontal sleeping position outwardly of the partitic wall, guide means including a slidable support link f slidingly supporting the berth frame to the out car side wall during movement of the berth fran from each position, latch means disposed on the berth frame for relea ably locking the berth frame on the outer car si wall and divider wall, and a support ledge extending above the seats for suppo ing the berth frame in the sleeping position.

2. The invention in accordance with claim 1, wherein the guide means comprises a guide track carried on the outer car side wall and a guide roller, the guide roller being supported for movement in the guide track.

3. The invention in accordance with claim 2, the guide track having a pair of end portions and wherein a stop member is disposed opposite each end portion of the guide track, the stop members retaining and limiting movement of the guide roller in the guide track.

4. The invention in accordance with claim 3, the support link having opposite end portions, one of the support link end portions being connected to the guide roller and the other end portion being pivotally connected to one end frame member, the one end frame member being adjacent to the outer car side wall.

5. The invention in accordance with claim 4, wherein an abutment block is carried on the outer car side wall for supporting a portion of the support link when the berth frame is in the sleeping position.

6. The invention in accordance with claim 4, wherein the latch means are carried by the front side frame member.

7. The invention in accordance with claim 6, wherein the latch means comprise a pair of latch levers, a latch pin secured to each latch lever and a latch keeper carried on the outer car side wall and the divider wall, the latch pins being adapted to releasably engage a respective latch keeper and secure the berth frame in one position.

8. The invention in accordance with claim 7, wherein the latch means comprise a plurality of vertically spaced latch keepers carried on the divider wall, the latch keeper on the outer car side wall being aligned with one latch keeper on the divider wall for securing the berth frame in the storage position.

9. The invention in accordance with claim 8, wherein a plurality of webs are secured to the front side frame member and the latch means comprise an elongated rod extending through and rotatably carried by the webs, the latch levers being connected to the opposite ends of the rod and means biasing the latch pins into engagement with the latch keepers.

10. The invention in accordance with claim 9, wherein a bell crank lever is fixedly secured to the rod, a handle bar is connected to the bell crank lever and the means biasing the latch pin comprises a torsion spring circumposing the rod and operatively secured to the rod and to the berth frame.

11. The invention in accordance with claim 10, wherein a storage closet is disposed between the seats and the divider wall, the storage closet including the support ledge.

12. In a railway passenger car including a compartment having an outer car side wall, a longitudinally extending divider wall spaced from the side wall, a partition wall laterally extending between the side and divider wall and laterally extending seats positioned adjacent the partition wall, the improvement comprising an upper berth arrangement having a berth frame defining the sleeping berth, the berth frame having front and rear side frame members and end frame members connected to the side frame members, hinge means connecting the rear frame side member to the partition wall for rotatably swinging the berth frame between a relatively vertical storage position adjacent to the partition wall and a relatively horizontal sleeping position outwardly of the partition wall, manually operable latch means carried on the front side frame member, the latch means comprising a pair of latch levers movably connected to the frame and a latch pin extending from each latch lever.

a first latch keeper carried on the outer car side wall, a plurality of vertically spaced second latch keepers carried on the divider wall, at least one second latch keeper being aligned with the first latch keeper for securing the berth frame in the storage position, a guide track carried on the outer car side wall, the guide track having closed ends, a guide roller supported in the guide track for movement between the closed ends, a support link having opposite end portions, one end portion of the support link being pinned to the guide roller and the other end portion being pivotally connected to one end frame member, the other end of the support link being cam-shaped and adapted to engage one latch lever and lock the berth frame in the sleeping position, an abutment block carried on the center car side wall supporting a portion of the support link and positioning the berth frame in the sleeping position, and means adjacent the divider wall for supporting an end of the berth frame in the sleeping position.

13. An upper berth arrangement connected to a first wall and supported on a pair of laterally extending second walls comprising a berth frame, hinge means connecting the berth frame and the first wall for rotatably swinging the berth frame between a sleeping position outwardly of the first wall and a storage position adjacent the first wall, a latch keeper carried on each second wall for supporting the berth frame, a pair of latch levers movably connected to the upper berth for engaging the latch keepers, a guide track carried on one second wall, a guide roller supported for movement in the guide track, a support link for slidably guiding and supporting an end of the upper berth, the support link having one end portion connected to the guide roller and the other end portion connected to the berth frame, the other end of the support link being adapted to lockingly engage one of the pair of latch keepers and secure the upper berth in one position.

14. The invention in accordance with claim 13, wherein an abutment block is carried on the one second wall, the abutment block supporting a portion of the support link in the one position.

* * * * *